United States Patent [19]

Grunewald

[11] 4,085,761

[45] Apr. 25, 1978

[54] DRAIN FILTER FOR A DISHWASHING MACHINE

[75] Inventor: Ernst Grunewald, Troy, Ohio

[73] Assignee: Hobart Corporation, Troy, Ohio

[21] Appl. No.: 730,134

[22] Filed: Oct. 6, 1976

[51] Int. Cl.[2] ..... B08B 3/02

[52] U.S. Cl. ..... 134/104; 210/167

[58] Field of Search ..... 210/167, 163, 164, 165, 210/166, 138, 144, 146, 148; 134/104, 72, 82

[56] References Cited

U.S. PATENT DOCUMENTS

| | | | |
|---|---|---|---|
| 1,593,550 | 7/1926 | Holt | 210/166 |
| 1,761,257 | 6/1930 | Fleming | 210/166 |
| 2,283,365 | 5/1942 | Heinkel | 210/166 X |
| 2,666,493 | 1/1954 | Gordon | 210/166 |
| 3,090,391 | 5/1963 | Kaldenberg et al. | 134/104 |
| 3,357,561 | 12/1967 | Schmid et al. | 210/163 |
| 3,378,858 | 4/1968 | Jacuzzi | 210/166 X |
| 3,469,698 | 9/1969 | Blendermann | 210/163 |
| 3,529,723 | 9/1970 | Hagedorn | 210/163 |

*Primary Examiner*—Theodore A. Granger
*Attorney, Agent, or Firm*—Biebel, French & Nauman

[57] ABSTRACT

The drain filter has large inlet openings at a raised position and small inlet openings at its bottom, all shaped to cooperate with the dishwashing machine sump to form labyrinthine drainage passageways to stop debris exceeding an acceptable size. The drain filter is in two parts, a fixed portion and a removable portion, both of which provide these features. The large inlet openings into the removable portion of the drain filter are upwardly facing and on the downstream side of an elevated wall which forms a dam to stop dense objects from entering the filter. The total filter inlet area is small to maintain a high flow velocity to float softer and lighter items over the dam for removal from the dishwasher when it is drained. The small inlet openings drain the remaining fluid after the level falls below the large openings.

5 Claims, 9 Drawing Figures

DRAIN FILTER FOR A DISHWASHING MACHINE

BACKGROUND OF THE INVENTION

This invention relates to dishwashing machines, and more particularly to a drain filter for preventing passage of hard or oversized articles into the drain and drain pump.

Conventional dishwashing machines replace the wash and rinse fluids several times during a cleaning cycle. For each fill, the fluid is first supplied to the dishwashing machine tank, then recirculated and sprayed onto the dishes, and then drained, to be followed several times again by the same sequence.

As the fluid is recirculated, it is filtered by a fine screen to prevent recirculation and redeposition of food particles back onto the dishes. Then as the fluid is drained, it is desirable to flush and drain away as much of the food items and debris as possible before refilling with fresh water. However, it is clearly not satisfactory to flush all of the soil items into the drain and drain pump. Some items may be too large or too hard (such as bones) for safe passage into the sewage system to which the drain is connected, and they might also damage the drain pump impeller.

A relatively coarse drain filter is therefore located over the entrance to the drain to stop such items. The openings through the drain filter are much larger than the openings in the fine screen filter so that much of the debris stopped by the latter can pass through the drain filter and be flushed down the drain.

Unfortunately, size alone is not a sufficient basis for separating drainable solids from those which should not be drained. Thus, cherry and olive pits, toothpicks, and broken pieces of glass and china, which may be quite small, clearly should not be permitted to enter the drain since they could damage the drain pump impeller. On the other hand, large bread crumbs and other soft food items can be safely passed through the drain, the drain pump, and the sewage system, and should therefore be removed even though they may be rather large. This therefore calls for some type of dynamic separation based on more than mere size discrimination.

Finally, the drain filter should be easily accessible to the machine operator so that the debris which it has stopped can be removed after the dishes have been cleaned.

SUMMARY OF THE INVENTION

Briefly, the present invention provides a substantially improved drain filter for use in a dishwashing machine. The drain filter is relatively small in size, occupying but a small segment of the circle surrounding the motor/-pump assembly in the sump at the bottom of the dishwashing machine tank. The preferred embodiment occupies less than 90° of this segment, and is located between the ends of a circular heating element also positioned around the motor/pump assembly in the sump bottom. The drain filter is thus conveniently small and includes a small, removable portion held by a manually releasable latch for easy handling and removal by the machine operator.

The small size of the drain filter also aids in proper separation of the drainable and nondrainable debris items. Its small size results in a small inlet area, substantially increasing the flow velocity of the draining fluid to keep suspended soil from settling in the bottom of the dishwashing machine. Subsequent washes and rinses are therefore cleaner since less soil remains for recirculation.

The drain filter also has a vertical wall extending upwardly from its base. This wall forms a type of dam in the fluid flow path from the dishwashing tank into the drain filter passageways. The dam prevents heavier objects, such as broken china or glass, from passing over and into the upwardly opening passageways of the drain filter inlet. Such potentially damaging objects therefore do not ordinarily pass through the drain filter to the drain pump impeller. They settle instead on the floor of the dishwasher tank outside the drain filter dam for later removal by hand.

Likewise, the upwardly facing drain filter openings, which are downstream of and below the dam, open into vertical passageways which connect to horizontal passageways. These in turn connect to a drain conduit leading to the drain pump. The vertical and horizontal passageways form a type of labyrinth of limited dimensions which admits items up to a certain predetermined size but will block passage of larger items. This function is assisted by a series of upstanding ribs extending transversely between the upwardly opening passageways. The ribs prevent long items such as toothpicks, fish bones, etc., from turning and working their way through the labyrinth to enter the drain passage where they could become trapped and obstruct proper draining, or could enter the drain pump and damage the impeller.

Of course, since the drain filter is removable, it is always possible for the machine operator to forget to replace it, or for the filter to come loose and be dispersed during a wash cycle if it has not been properly latched. The present invention therefore divides the drain filter into two portions, one of which is fixed in place in the sump at the bottom of the dishwasher tank, and the other of which is removably attached to the fixed part by a manually operable latch. Both filter portions, in conjunction with the downwardly and inwardly shaped side and bottom walls of the sump, provides a two level filter inlet configuration. The first or upper inlets of each filter portion are located at predetermined positions above the base of the drain filter and the sump. The second or lower inlets into each filter portion extend to the bottoms thereof to drain fluids to the very bottom of the sump. Both sets of inlets open into labyrinthine passageways connecting through the filter portions. The passageways through the upper inlets will pass items up to a first predetermined size and will block passage of larger items. The passageways through the lower inlets are shaped to pass only much smaller items. Thus large size floating and suspended debris can be removed through the upper openings while the fluid level is above the position thereof. However, small dense items will fall to the floor of the dishwasher tank and will not ordinarily float into the upper drain filter openings, nor can they ordinarily enter the much smaller lower openings. Thus drainable items are largely removed, while non-drainable items are stopped. The lower openings provide for draining the sump to its bottom, and the labyrinthine passageways help stop such floating and potentially damaging items as toothpicks and fish bones.

It is therefore an object of the present invention to provide an improved drain filter for a dishwashing machine; a drain filter which blocks passage of oversized articles into the dishwashing machine drainage system; which drains small and softer disposable items but employs two differently sized inlet levels to stop harder objects from entering the drain while draining the dishwasher tank to its bottom; which has labyrinthine passages to block hard objects larger than a predetermined size; which is relatively small for easy cleaning and servicing, and for maintaining a large flow velocity during draining of the fluid; and which is uncomplicated, inexpensive, durable, and readily suited for use in a wide variety of dishwashing machine applications.

Other objects and advantages of the invention will be apparent from the following description, the accompanying drawings and the appended claims.

DESCRIPTION OF THE PREFERRED EMBODIMENT

Figure 1:
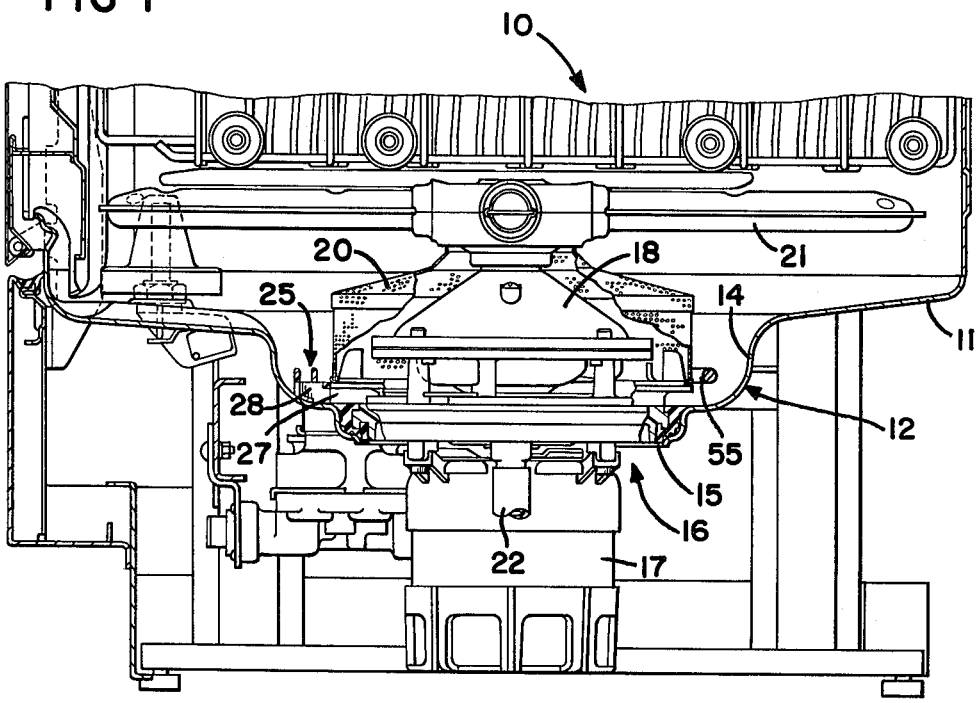
FIG. 1 is a partially broken away cross-sectional view of the lower part of a domestic dishwashing machine incorporating the drain filter of this invention.
Figure 2:
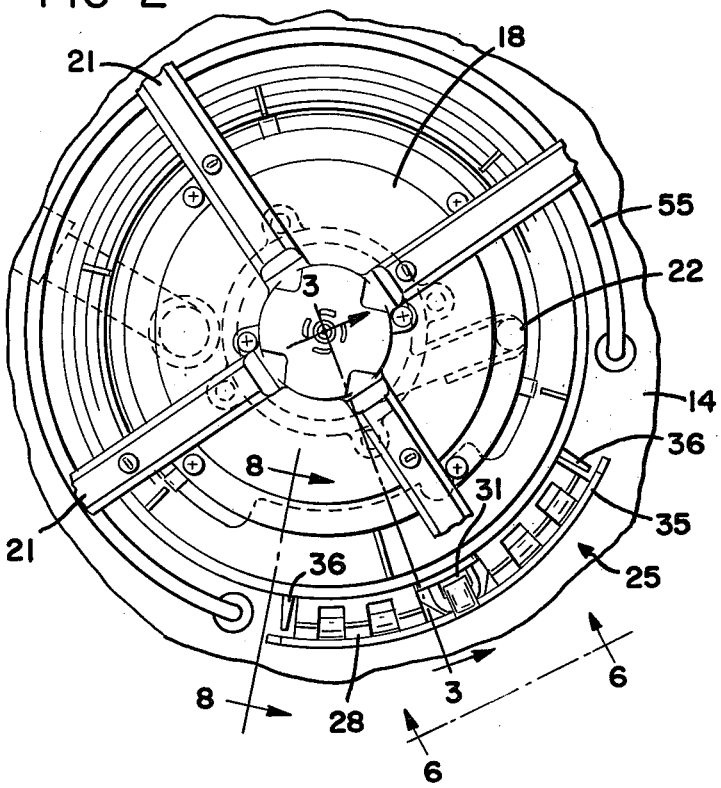
FIG. 2 is a fragmentary plan view of those dishwashing machine components which are mounted in the sump of the dishwashing machine tank, some portions, including the fine screen filter, having been omitted for clarity of illustration.
Figure 3:
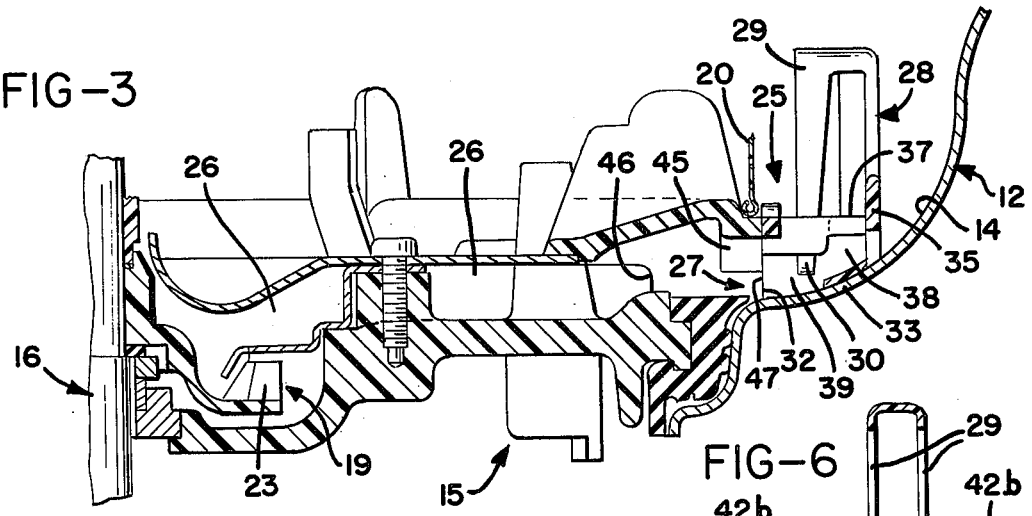
FIG. 3 is an enlarged cross-sectional view taken somewhat generally on line 3—3 of FIG. 2.
Figure 6:
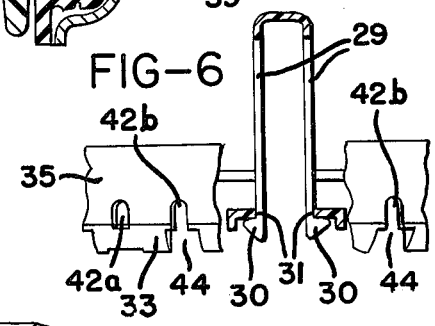
FIG. 6 is a partially broken away fragmentary view taken on view line 6—6 of FIG. 2.
Figure 4:
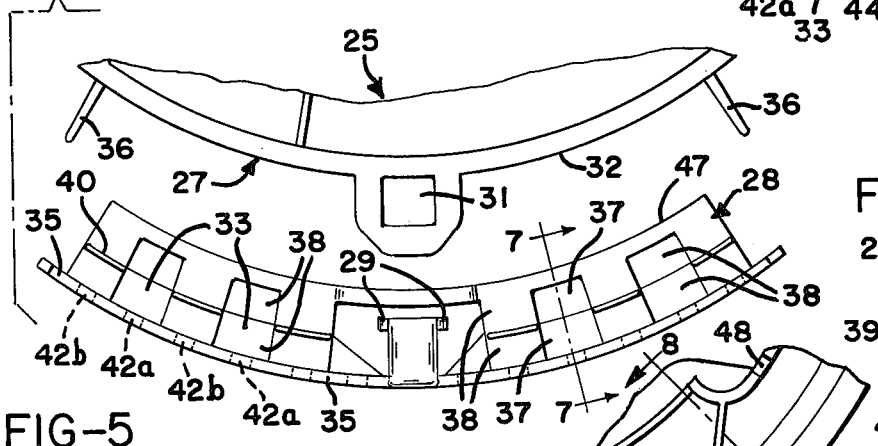
FIG. 4 is an enlarged, separated plan view of the drain filter.

FIG. 1 illustrates the lower part of a dishwashing machine 10 having a tank 11 which defines a washing chamber for the dishes. A sump 12 in the bottom of the tank 11 is defined by a downwardly and inwardly curved wall 14 along the outer perimeter of the sump 12. An opening 15 in the center of the bottom of sump 12 mounts a motor/pump assembly 16, the latter including a motor 17, a recirculating pump 18, and a drain pump 19 (FIG. 3). Fluid which is to be recirculated is drawn into the recirculating pump 18 through a fine screen filter 20, and then sprayed upon the dishes in known manner by a rotating spray arm assembly 21. The recirculating and drain pumps 18 and 19 are vertically and coaxially aligned above the motor 17 and are simultaneously driven therewith.

When washing or rinsing fluids are to be drained from the dishwashing machine tank 11, a drain valve (not shown) in the drain pump outlet line 22 is opened permitting the drain pump impeller 23 (FIG. 3) to draw the fluid from the sump 12 through a drain filter 25 and into a drain conduit 26 which leads from the filter 25 to the drain pump 19. The drain pump impeller 23 then discharges the fluid through the outlet line 22 (FIG. 1).

Drain filter 25 is divided into two parts, a fixed portion 27 and a removable portion 28. The removable portion 28 is removably mounted on the fixed portion 27 at the bottom of the downwardly and inwardly curved sump wall 14, and is held in position by a pair of manually inwardly displaceable retainer prongs 29 which have heads 30 which snap into and engage the outer edges of a retainer opening 31 formed at and secured to the inlet opening 32 into the fixed drain filter portion 27. Retainer opening 31 and retainer prongs 29 form parts of a complementary mount for the removable filter portion 28. The fixed filter portion 27 and retainer 31 are permanently attached to the dishwashing machine 10 at the bottom of the tank 11 when the motor/pump assembly 16 is installed in opening 15. Fixed portion 27 of filter 26 is then in the fluid flow path between the dishwasher tank sump 12 and the drain pump conduit 26 (FIG. 3), and when the removable filter portion 28 is installed in position on the openings 31 and 32, prongs 29 hold it in the same fluid flow path between the dishwasher tank sump 12 and the drain pump conduit 26.

The removable filter portion 28 has a base 33 which is dimensioned to be seated on the sump wall 14 (FIG. 3). Attached to base 33 is a wall 35 which extends vertically upwards from the base and forms a dam when in place in the dishwashing machine sump 12, the outside of the dam wall 35 being locatable opposite the downwardly and inwardly curved wall 14 of the sump. The prongs 29 are also supported on the dam wall 35, as illustrated in FIG. 3, and the ends of the dam wall 35 are closed by dam wings 36 which form a part of the fixed drain filter portion 27 and extend outwardly from the opposite sides thereof.

The body of the removable filter portion 28 also includes a series of openings 37 through the top thereof which are downstream of and below the dam wall 35. Openings 37 are located well above the bottom of the sump 12, at a predetermined position above the base of the drain filter 25, and above the base 33 of the removable filter portion 28. The openings 37 open into corresponding vertical passageways 38 which are dimensioned to pass items up to a predetermined size and to block passage of larger items. The vertical passageways 38 merge downwardly into horizontal passageways 39 also dimensioned to admit items substantially as large as the predetermined size and to block passage of larger items. The vertical passageways 38 and horizontal passageways 39 change the direction of the fluid flow from vertical to horizontal as it passes through the removable filter portion 28. In doing so, the passageways define a labyrinth which is dimensioned to block passage through filter 25 of items, such as toothpicks, which are too long to make this turn from vertical to horizontal. The performance of this labyrinth is further enhanced by a series of upstanding ribs 40 which extend transversely between the vertical passageway openings 37. Ribs 40 tend to prevent toothpicks, fish bones, and other long objects from turning and passing through the drain filter passageways 38 and 39 into the drain conduit 26 (FIG. 3) where they could become trapped and obstruct proper draining, or could pass to and damage the drain pump impeller 23.

Figure 7:
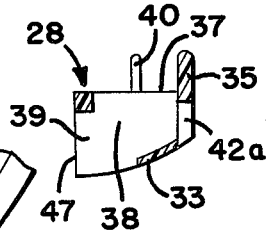
FIG. 7 is a cross-sectional view taken on line 7—7 of FIG. 4.
Figure 5:
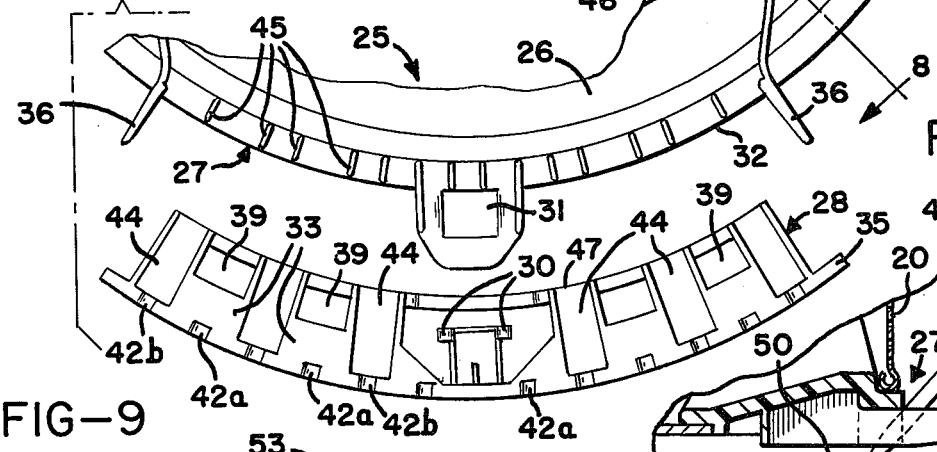
FIG. 5 is an inverted view similar to FIG. 4.

A series of small inlet openings 42*a* and 42*b* passes through the bottom of the dam wall 35, the openings extending to the base 33 at the bottom of the filter portion 28. The openings 42*a* and 42*b* are smaller in dimension than the vertical and horizontal passageways 38 and 39, and are for draining the remaining fluid from the sump 12 after the fluid level falls below the upper edge of the openings 37 into the filter portion 28. As shown in FIGS. 5 and 7, alternate ones of the openings, designated 42*a*, connect through wall 35 and open into the horizontal passageways 39. The remaining passageways, designated 42*b*, connect to and open into a series of connecting passageways 44 which are closed on their tops and sides and are positioned between the horizontal passageways 39 and pass to and through the opposite side of the removable filter portion 28. The connecting passageways 44, which lie beneath the upstanding ribs 40, thus connect the remaining small openings 42*b* to the inlet opening 32 into the fixed portion 27 of the drain filter 25. As illustrated in FIG. 3, the openings 42*a* and 42*b* face the downwardly and inwardly curved wall 14 of the sump 12, and the openings and wall thus form another labyrinth which prevents long thin objects such as toothpicks from entering the drain conduit 26 through the openings 42*a* and 42*b* and their corresponding passageways 39 and 44.

Since filter portion 28 is removable, the fixed portion 27 has teeth 45 which complement the walls of the horizontal and connecting passageways 39 and 44 (FIG. 5). Teeth 45 and sump wall 14 form labyrinthine passageways (FIG. 8) connecting the fixed filter portion inlet 32 to its outlet 46. Thus, when the removable filter portion 28 is in position adjacent the fixed filter portion 27, the outlet 47 of the removable filter portion 28 passes the fluid directly to the fixed filter portion inlet 32. But in the absence of the removable filter portion 28, the teeth 45 define passageways through the fixed filter portion 27 of substantially the same predetermined size as those in the removable portion 28.

Figure 8:
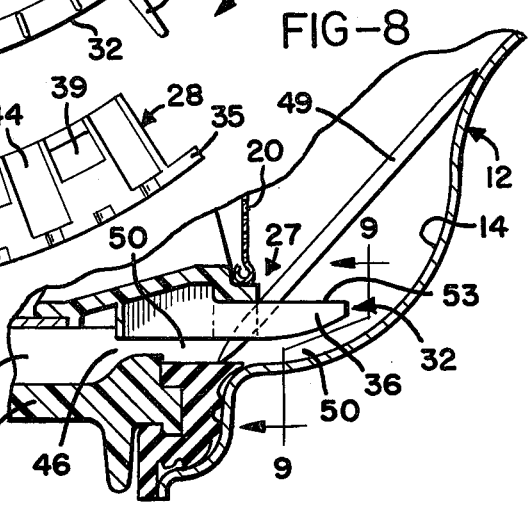
FIG. 8 is a fragmentary cross-sectional view taken somewhat generally on line 8—8 in FIG. 2, the removable part of the drain filter having been removed, and the section line also crossing the drain inlet on line 8—8 as illustrated in FIG. 5.
Figure 9:
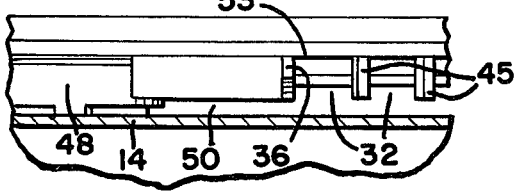
FIG. 9 is a fragmentary view taken generally on section line 9—9 of FIG. 8.

More particularly, the fixed filter portion 27 has a base 48 (FIGS. 5 and 9) which rests on the motor/pump assembly 16 at the level of the floor of the sump 12. The fixed filter portion inlet 32 faces the downwardly sloping sump wall 14 and, in the preferred embodiment, employs this sump wall as an integral part of the drain filter system. Thus, as illustrated in FIG. 8, the sump wall 14 and teeth 45 form labyrinthine passageways which are dimensioned and shaped to pass items up to the first predetermined size and to block passage of larger items. As illustrated in FIG. 8, for example, a toothpick 49 has been stopped between the sump wall 14 and the fixed filter portion 27, and has been prevented from entering the drain conduit 26.

As with the removable filter portion 28, the fixed portion 27 provides a two level inlet configuration for rapidly draining large, suspended debris, while stopping most denser debris, even if considerably smaller. In this case, the smaller openings into the fixed filter portion 27, which extend to the bottom thereof, are provided by narrow channels 50 (FIGS. 8 and 9) which pass beneath and are defined by the dam wings 36. These channels are dimensioned to pass items up to the second, smaller predetermined size, and to block passage of larger items.

The tops of the dam wings 36 are at the same height as the openings 37 into the removable filter portion 28 when the latter is in position on the fixed filter portion 27. Thus, whenever the fluid level is above the tops of the dam wings 36, the fluid and its suspended debris can enter the fixed filter portion 27 directly through its inlet opening 32. From a dynamic standpoint, therefore, the tops of the dam wings 36 define the two ends of the elevated or upper opening 53 (FIGS. 8 and 9) of the fixed filter portion 27. When the removable filter portion 28 is in position on the fixed filter portion 27, the removable portion 28 is then located within the opening 53, so that the effective opening into the fixed filter portion 27 is its opening 32. However, when the removable filter portion 28 is absent, the sump wall 14 and dam wings 36 create an elevated barrier which establishes the effective upper opening 53, above opening 32. This upper opening 53 is at approximately the same position above the base 48 of the fixed filter portion 27 as are the openings 37 of the removable filter portion 28 when it is in position. Thus, when the removable filter portion 28 is absent, the fixed filter portion 27 establishes the same two level inlet configuration and provides substantially the same type of dynamic debris separation afforded by the removable filter portion 28.

As may be seen, therefore, the present invention provides numerous advantages. It is highly effective in flushing softened and suspended food waste items down the drain during the draining cycles, and due to its small size, a good flow rate is maintained which prevents such items from settling. The small size also makes it easy to service and clean the filter, and permits it to be shaped for positioning in the bottom of the sump around a segment of the circumference of the motor/pump assembly 16, between the ends of a heating element 55 which is commonly provided in the sump 12 around the motor/pump assembly 16. The elevated inlet openings into the drain filter portions provide for rapidly draining fluids and suspended debris small enough to pass through the filter openings, while stopping debris which is too large or too dense to float up to the elevated, predetermined position of the inlet openings. The dam wall of the removable filter portion also helps to remove dense, hard objects since such objects will not ordinarily be washed over the dam wall but will settle at its base where they can be subsequently removed. The smaller inlet openings which extend to the bottom of the filter portions provide for continued draining of the fluids after the fluid level has fallen below the position of the elevated openings. The smaller size of the lower inlet openings terminates draining of the larger sized debris, and also excludes entry of the denser debris items which have settled to the floor of the dishwashing machine tank. The labyrinthine passageways and the upstanding ribs also help catch long thin objects which might otherwise enter the drain conduit.

While the form of apparatus herein described constitutes a preferred embodiment of this invention, it is to be understood that the invention is not limited to this precise form of apparatus, and that changes may be made therein without departing from the scope of the invention.

What is claimed is:

1. A dishwashing machine including a drain filter for filtering out certain waste items when the dishwashing machine is being drained, the dishwashing machine having a tank, a drain pump for draining water from the tank, a drain conduit having an opening into the tank for sealing against the drain filter for receiving filtered fluid therefrom and conveying it to the drain pump, a sump in the bottom of the tank, and a motor/pump assembly for recirculating water from the sump onto dishes supported within the tank, the drain filter comprising:

(a) a two portion filter body dimensioned to be seated on said sump, one of said portions being fixed thereon and the other removable, (b) manually operable means for attaching and releasing said removable filter portion to and from said fixed filter portion in a predetermined position with respect thereto and in the fluid flow path between the dishwasher tank and the drain conduit, and (c) each portion of said drain filter separately including its own:
(i) base,
(ii) body portion extending upwardly from the respective said base,
(iii) means defining a first inlet opening into the respective said body portion located at a predetermined position above the respective said base,
(iv) means forming an outlet opening through the respective said drain filter portion,
(v) means forming labyrinthine passageways connecting said first inlet opening to said outlet opening through each said drain filter portion, said passageways being dimensioned and shaped to pass items up to a first predetermined size and to block passage of larger items,
(vi) means forming a second inlet opening into the respective said body portion extending to the bottom thereof, and
(vii) means connecting said second inlet opening to said outlet opening and being dimensioned to pass items up to a second predetermined size and to block passage of larger items, said second predetermined size being substantially smaller than said first predetermined size, said drain filter rapidly draining fluids and suspended debris smaller than said first predetermined size when the fluid level is above said predetermined position, and continuing to drain fluids after the fluid level has fallen below said predetermined position, the passage through the drain filter of debris larger than said second predetermined size being effectively terminated when the fluid level has fallen therebelow.

2. The drain filter of claim 1 wherein said drain filter is shaped as a portion of a circular annulus positionable in the bottom of the sump around a segment thereof.

3. The drain filter of claim 1 wherein said removable filter portion further comprises:
(a) a wall extending substantially vertically upwardly along the upstream side thereof and forming a dam along that side of the removable filter portion, and
(b) said inlet to said removable filter portion being through the top of said filter downstream of and below said dam.

4. The drain filter of claim 3 further comprising upstanding ribs extending transversely across said removable filter portion inlet on the top of said removable filter portion to assist in retaining and blocking passage of items greater in length than said predetermined size.

5. A dishwashing machine including a drain filter for filtering out certain waste items when the dishwashing machine is being drained, the dishwashing machine having a tank, a drain pump for draining water from the tank, a drain conduit having an opening into the tank for sealing against the drain filter for receiving filtered fluid therefrom and conveying it to the drain pump, a sump in the bottom of the tank, the sump having downwardly and inwardly curved walls along the outside thereof, a motor/pump assembly mounted in the sump, and a heating element in a segment of the sump around the motor/pump assembly, the drain filter comprising:
(a) a two portion filter body dimensioned to be seated on said sump, one of said portions being fixed and the other removable, said drain filter being shaped as a portion of a circular annulus positionable in the bottom of the sump around a segment of the circumference of the motor/pump assembly between the ends of the heating element in the sump,
(b) manually operable means for attaching and releasing said removable filter portion to and from said fixed filter portion in a predetermined position with respect thereto and in the fluid flow path between the dishwasher tank and the drain conduit,
(c) said fixed portion of said drain filter including:
(i) a base,
(ii) a fixed body portion extending upwardly from said base,
(iii) means defining a first inlet opening into said fixed body portion located at a predetermined position above said base,
(iv) means forming an outlet opening through said fixed body connecting into the drain conduit,
(v) means forming labyrinthine passageways connecting said first inlet opening into said fixed body portion to said outlet opening therein, said passageways being dimensioned and shaped to pass items up to a first predetermined size and to block passage of larger items,
(vi) means forming a second inlet opening into said fixed body portion at the bottom thereof, and
(vii) means connecting said second inlet opening into said fixed body portion to said outlet opening therein, and being dimensioned to pass items up to a second predetermined size and to block passage of larger items, and
(d) said removable portion of said drain filter including:
(i) a base,
(ii) a removable body portion extending upwardly from said base,
(iii) a wall on said removable filter portion extending substantially vertically upwardly along the upstream side thereof and forming a dam along that side, the outside of said dam wall being locatable opposite the downwardly and inwardly curved wall of the sump,
(iv) means forming vertical passageways opening upwardly opposite the downstream side of said of dam wall, below the top edge thereof, and at a predetermined position above the base of said removable portion, said predetermined position being at substantially the same height and position as said predetermined position of said fixed filter portion inlet opening, said passageways being dimensioned to admit items substantially as large in cross section as said first predetermined size and to block passage of larger items,
(v) means forming horizontal passageways beneath and connecting with said vertical passageways, said horizontal passageways passing through the side of said drain filter opposite said dam wall, said horizontal passageways being dimensioned to admit items substantially as large in cross section as said first predetermined size and to block passage of larger items, and said horizontal passageways cooperating with said vertical passageways and the top of said dam wall to form a labyrinth, when said removable filter portion is in position in the dishwasher sump, for blocking passage of items of greater length than said first predetermined size,
(vi) means providing openings through said dam wall near its base, said openings being dimensioned to pass items up to said second predetermined size, and alternate ones of said openings connecting through said dam wall and opening into said horizontal passageways, (vii) means forming connecting passageways closed on their tops and sides and positioned between said horizontal passageways and passing through the side of said removable filter portion opposite said dam wall, the remaining said dam wall openings connecting to and opening into said connecting passageways, and (viii) upstanding ribs extending transversely between said vertical passageways and across the tops of said connecting passageways to assist said labyrinth of said removable filter in retaining and blocking passage of items greater in length than said first predetermined size, said second predetermined size being substantially smaller than said first predetermined size for rapidly draining fluids and suspended debris smaller than said first predetermined size when the fluid level is above said predetermined position, and for continuing to drain fluids after the fluid level has fallen therebelow, the passage through the drain filter of debris larger than said second predetermined size being effectively terminated when the fluid level has fallen therebelow.

* * * * *